US005752343A

United States Patent [19]

Quintus

[11] Patent Number: 5,752,343

[45] Date of Patent: May 19, 1998

[54] UNIVERSAL GARAGE DOOR CLOSER

[76] Inventor: James B. Quintus, 2008 Cedar Ridge Rd., Edmond, Okla. 73013

[21] Appl. No.: 639,406

[22] Filed: Apr. 29, 1996

[51] Int. Cl.[6] ..... E05F 15/20

[52] U.S. Cl. ..... 49/29; 49/31

[58] Field of Search ..... 49/199, 200, 29, 49/30, 31, 25; 160/188, 189

[56] References Cited

U.S. PATENT DOCUMENTS

| | | | |
|---|---|---|---|
| 2,902,276 | 9/1959 | Purdy | 49/30 X |
| 3,783,556 | 1/1974 | Cook | 49/30 X |
| 4,197,675 | 4/1980 | Kelly | 49/199 X |
| 4,365,250 | 12/1982 | Matsuoka et al. | 49/31 X |
| 4,433,274 | 2/1984 | Duhame | 49/31 X |
| 4,614,057 | 9/1986 | Sorber | 49/29 |
| 4,821,024 | 4/1989 | Bayha | 49/30 |
| 5,027,553 | 7/1991 | Vergara | 49/30 |
| 5,282,337 | 2/1994 | Duhame et al. | 49/199 |
| 5,357,183 | 10/1994 | Lin | 49/30 X |
| 5,428,278 | 6/1995 | Bollengier et al. | 49/30 |

*Primary Examiner*—Kenneth J. Dorner
*Assistant Examiner*—Curtis Cohen
*Attorney, Agent, or Firm*—John E. Vandigriff

[57] ABSTRACT

An add-on control device is shown that is used in conjunction with existing garage door opener systems. The device includes an electronic control device that will automatically close the door if left open, or can be programmed to stay open, and will automatically close an open door when it gets dark. The device includes a control circuit, connected in parallel with the push button control of the garage door opener, actuated when the garage door is opened. A timing circuit having at least two selectable timing cycles is actuated when the garage door is opened and closes the garage door after a selected timing cycle. A cancel circuit cancels the selected timing cycle when the garage door is to remain open. A reset circuit, called the cancel switch is used for re-initiating the selected timing cycle to close the garage door.

14 Claims, 5 Drawing Sheets

UNIVERSAL GARAGE DOOR CLOSER

FIELD OF THE INVENTION

The invention relates to garage door openers, and more particularly to an add-on control device used in conjunction with standard garage door openers for providing additional control features for controlling the closing of a garage door.

BACKGROUND OF THE INVENTION

Over the years, overhead garage door opener systems have become quite popular. They are usually controlled by a radio controlled transmitter and receiver system or by a switch usually installed in the garage in a handy place. While these systems usually work quite satisfactorily most of the time, there are situations where stray radio signals, electrical or electromagnetic disturbances have caused garage doors to open and remain open. Also many persons have driven off when exiting their garage and are not sure if they closed the garage door and have returned to their home to make sure that it is closed. Many patents have been issued in the subject of closing or reclosing the garage door after a period of time.

U.S. Pat. No. 4,035,702, relates to a garage door opener device that determines when a door is open or closed and automatically actuates the motor for closing the door in the event the door is open or inadvertently left open.

U.S. Pat. No. 4,365,250 is to a garage door apparatus that has a detection circuit for detecting the open or closed condition of the garage door.

U.S. Pat. No. 5,027,553 defines a device for automatically closing the door after a delay following the door being opened by a driver and movement of a vehicle out of the garage. The device prevents the door from being inadvertently left open.

Prior art garage door openers generally have built-in devices as described above and do not allow for variance of the open time, or variable delay of closing. Some garage door openers have devices for preventing the garage door from closing when there is an obstruction or object in the door opening.

SUMMARY OF THE INVENTION

This invention relates to an add-on control device that is used in conjunction with any existing garage door opener systems. The device includes an electronic control device that will automatically close the door if left open, or can be programmed to stay open, and will automatically close an open door when it gets dark.

The garage door is closed in the event a person forgets to do so upon entering or exiting the garage. The automatic closing time may be varied or disabled for cleaning or airing, etc. In the event that the garage door is intended to be open, a photo sensor monitors ambient light so that the door will be closed in the evening as darkness approaches, or on a cloudy day when there may be rain. The level of light that is needed for the door to remain open may be varied.

This device can be used with any type or style of overhead garage door opener or similar device that has two wires going to a remote switch normally found within the garage. It can be used with garage door openers that have a safety infrared motion detector system as well as other safety devices that may be built into or added to a garage door opener or similar device.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
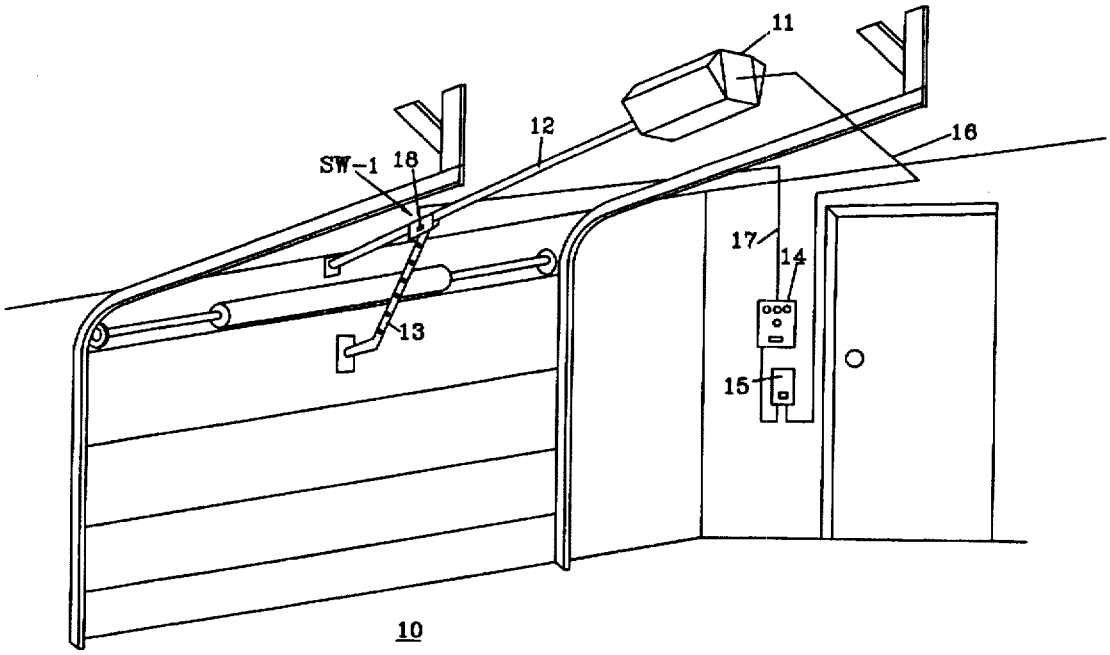
FIG. 1 shows a garage door, door opener and the add-on control device of the present invention.

FIG. 1 shows a garage door 10 which is opened and closed by door opener 11. Opener arm 13 moves along opener arm track 12. Opener arm 13 is moved along arm track 12, usually, by either a chain or screw drive powered by a motor (not illustrated) in opener 11.

Opener 11 is actuated either by a remote transmitter (not illustrated) or a switch 15 connected to opener 11 by control wires 16. By pressing switch 15, door 10 may be opened or closed. Add-on device 14 is connected in parallel with switch 15, and is also connected to switch 18, on arm tract 12 by wires 17.

Figure 2:
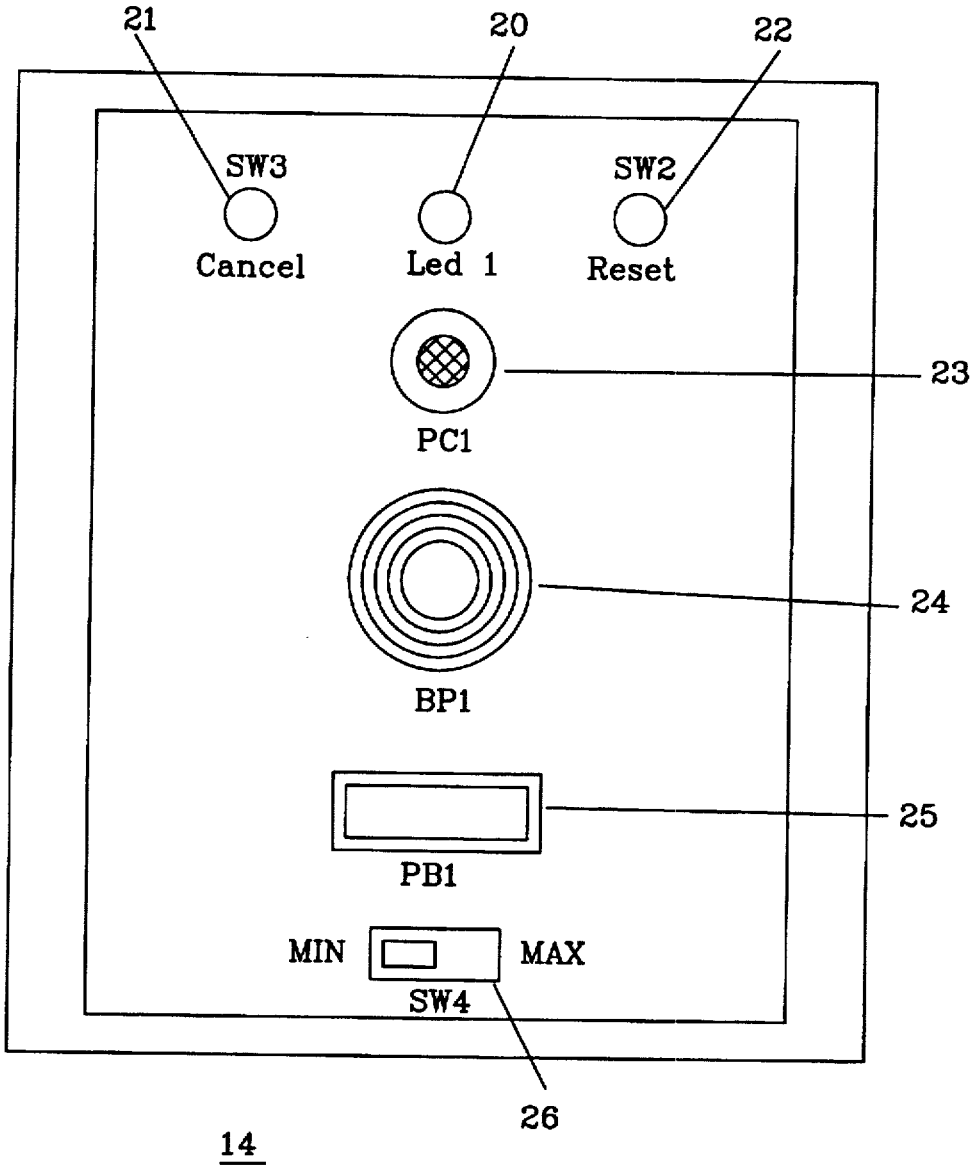
FIG. 2 shows the control panel of the add-on device.

FIG. 2 shows the front panel 20 of add-on device 14 which holds several controls and display elements. Delay switch 21, (SW3 FIG. 5) is pressed to delay or cancel the normal closing of the door for a preset delay time. To cancel or reset the delay or cancel, switch 22 (SW2 in FIG. 5) is pressed. Photo cell 23 (PC1) is used to detect a predetermined decrease in light so that door 10 is automatically closed at night or dark cloudy rainy days. Beeper 24 (BP1) emits a sound to indicate that the door will be closing. Push button switch 25 (PB1) is used to close or open the garage door independent of other controls and is in parallel with switch 15, FIG. 1, or may be a replacement for switch 15. Switch 26 (Sw4) has two positions, Min and Max. Switch 26 is used, in the Min position, to place the delay time in closing the garage door to a preset minimum, and, in the Max position, to place the delay time in closing the garage door to a preset maximum.

Figure 3:
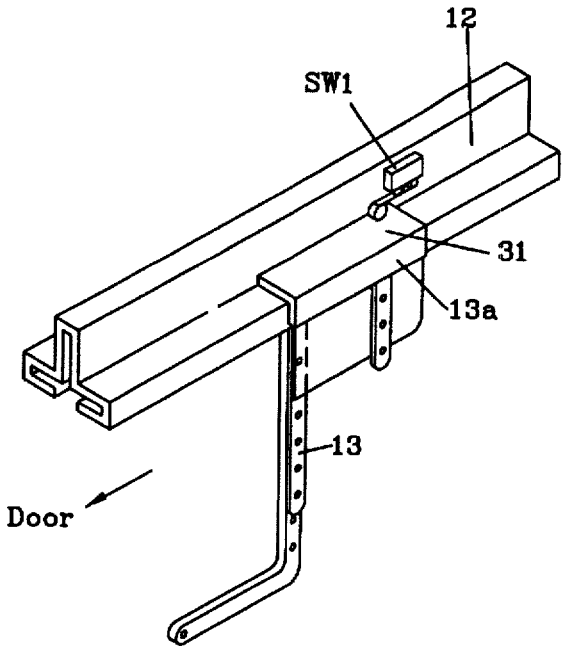
FIG. 3 shows a control switch mounted on the opener arm track with the door in a closed position.

FIG. 3 shows switch Sw1 on door opener arm track 12 which is used to energize the add-on device anytime the garage door is open or not fully closed. FIG. 3 shows Sw1 actuated when garage door 10 is closed. Arm 31 is flexed upward, when door opener arm slide 13*a* is under Sw1, opening SW1, removing power to the add-on device. When opener arm slide 13*a* is not under Sw1, switch Sw1 is in the normally closed position supplying power to the add-on device.

Figure 4:
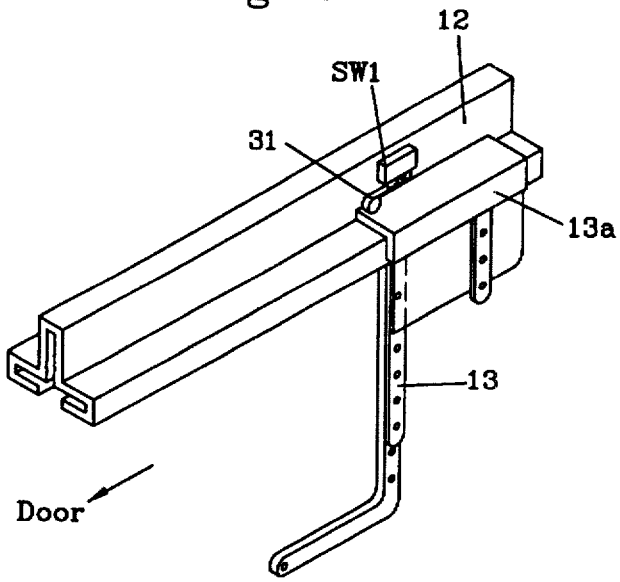
FIG. 4 shows a control switch mounted on the opener arm track with the door in a partially opened position.

FIG. 4 shows door opener arm slide 13*a* moved away from the closed door position by about three or four inches. This allows garage door 10 to be opened several inches to allow air into the garage, or provide access to the garage by small animals, and Sw1 is actuated, thereby removing power to the add on device 14.

Figure 5:
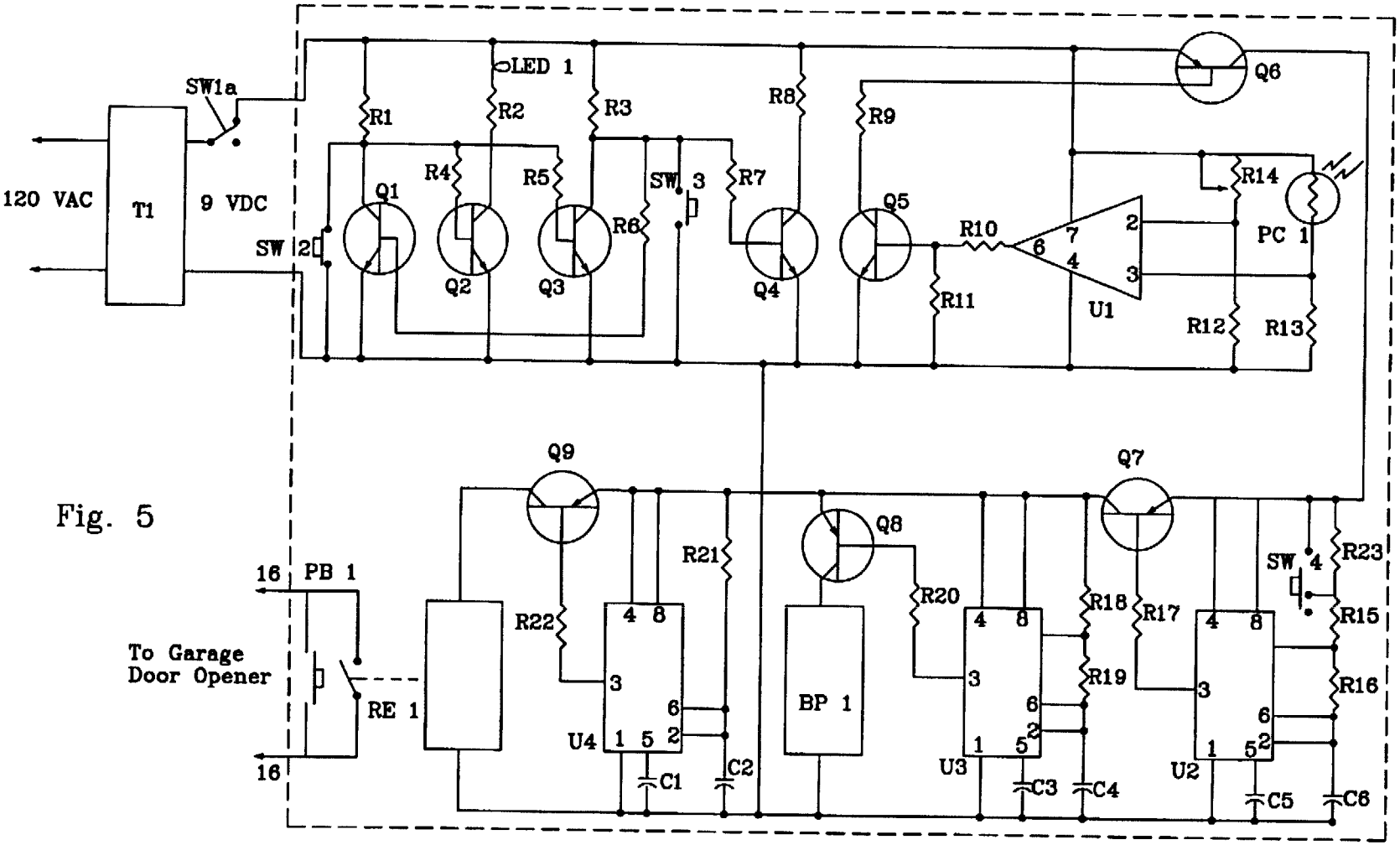
FIG. 5 shows one example of a control circuit for the add-on device.

FIG. 5 shows an example of a control circuit for add-on device 14. Transformer T1 is plugged into a standard 120 vac outlet. The output of this power supply is, for example, 9 volts dc. Switch Sw1 is a lever operated switch mounted on the stationary rail 12 of the garage door opener system. When garage door 10 is not fully closed, Sw1 is closed and provides supply voltage to the add-on device 14, the circuit of FIG. 5.

Transistor Q1 is turned on producing a low at the base of Q2 and Q3 keeping them turned off. A high appearing at the collector of Q3 turns Q4 on producing a low at the collector of Q4. This low turns on Q6 allowing the supply voltage to pass through Q6 to the first timing circuit U2. With R23 shorted out, with Sw4 in the Min position, the timing interval is, for example, approximately four minutes. With Resistor 23 unshorted, with Sw4 in the Max position, the timing interval is, for example, approximately 30 minutes. Resistors R15, R23 and switch Sw4 may be replaced, for example, by a variable potentiometer to provide a continuously variable delay time.

At the end of the timing interval, pin 3 of U2 goes low, turning on Q7, allowing the supply voltage to pass through Q7 to the second timing circuit U3. Pin 3 of U3 will alternately go low and high turning on and off Q8 which turns on Beeper BP1. At the same time, the supply voltage is fed to the timing circuit of U4. At the end of its timing interval, pin 3 will go low turning on Q9 which pulls in RE1 whose normally open contacts are across push button switch PB1. PB1 is the manual push button, and the garage door system receives a signal to close the door.

To cancel closing of the door 10, SW3 is pushed which puts a low into Q1 turning it off. A high at the collector of Q1 and turns on Q2 and LED1. Q3 is also turned on and provides a low to Q1 which keeps Q1 turned off. The output of Q4 is high which inhibits Q6, and the timing circuits (U2–U4) cannot function. The output of U1 is low and provides a low to Q5, and Q6 continues to be inhibited. When the ambient light level decreases, the resistance of PCI changes and causes U1 to change its output to go high, turning on Q5, which enables Q6, and the supply voltage is applied to the timing circuit through Q6.

To reset the delay in closing door 10, SW2 is pushed, and a low is applied to Q3, which makes its output go high, and enables Q6 applying the supply voltage to the timing circuits.

Figure 6:
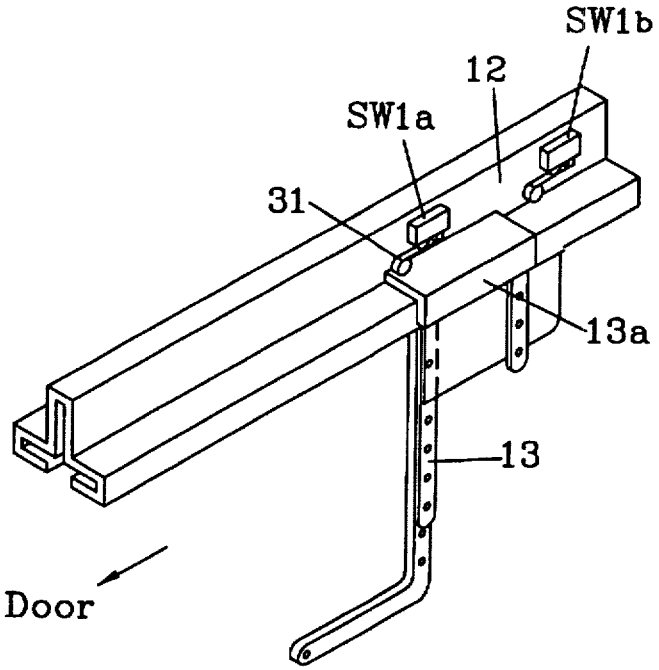
FIG. 6 illustrates the use of two switches to determine the partially open position of a garage door.
Figure 7:
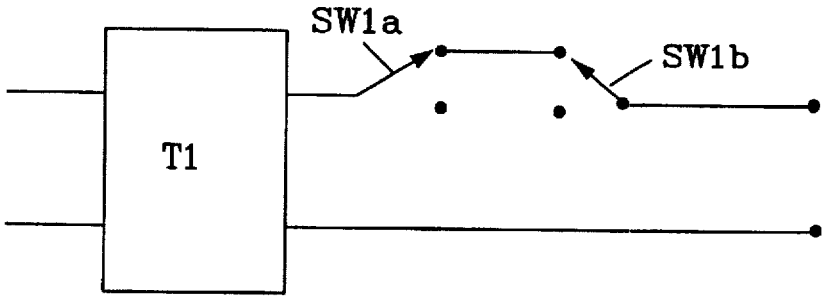
FIG. 7 shows the wiring of the two switches of FIG. 6.

FIG. 6 shows an alternative using two switches Sw1*a* and Sw1*b* on track 12. Switches Sw1*a* and Sw1*b* are located a few inches apart and are connected in series as shown in FIG. 7. Sw1*a* is actuated when door 10 is fully closed and power is removed. Sw1*b* is actuated when the door 10 manually opened to approximate four inches, and power is removed.

The basic operation of the garage door add-on device is as follows. The add-on device 14 is connected to garage door opener system mechanism by merely connecting the wires 16 that normally are connected to the service switch 15. The add-on device has a service switch PB1 built into the mechanism that will also permit manual operation of the garage door system.

When garage door 10 is opened, a solid state timing circuit or oscillator U2 is activated. Solid state timing circuit U2 has a time selectable from approximately four minutes to approximately thirty minutes. The shorter time is usually sufficient in most cases, but a longer time may be desirable in the winter time when one might want to warm up the vehicle before you use it. In this case you want to keep the garage door open so that Carbon Monoxide fumes will not build up in the garage causing a health problem. In the winter time you increase the time setting by moving the slide switch Sw4 to the right (maximum time). Moving the slide switch to the left selects the shorter time.

At the end of the timing period (four minutes or thirty minutes), another timing circuit U3 is started which controls a solid state beeper BP1 which emits an alternating on and off sound which alerts you that the garage door is about to be closed. While beeper BP1 is sounding, a third solid state timer U4 has been in operation which will activate a relay RE1 whose contacts parallel the manual service switch PB1 and garage door 10 starts to close. The beeper sounds for a short period of time after the relay is actuated. This is done deliberately to silence the beeper.

If garage door 10 were to be in motion and suddenly received a new command, either by a transmitted signal, manual operation, or safety switch of some type, garage door 10 reverses its action and opens itself and stays open. The first solid state timer U2, by its design, will recycle itself and in approximately four minutes or thirty minutes, will attempt to close door 10. This feature of the timer or oscillator is called the Recyclor feature.

The power that is supplied to add-on device 14 is controlled by a switch Sw1 that closes when garage door 10 is opened. When the door is closed, switch Sw1 opens and removes the power to the add-on device.

The location of switch Sw1 is usually on the stationary rail 12 and is actuated by the moving part 13*a* of the drive mechanism of the door opener system. Switch Sw1 can be positioned along rail 12 so that when door 10 is completely closed, switch Sw1 is activated (opened) and the power to add-on device 14 is removed. The position of switch Sw1 can be changed slightly so as to allow the garage door to be opened slightly (three or four inches) for small animals to enter and exit the garage. In this case, switch Sw1 is still activated and the power to the device 14 is removed. The opening of door 10 this small amount is a manual operation. If the door opener system is given a manual command, or a command by this device, or a transmitted signal command, the door will close completely. If door 10 is to be opened a small amount, door 10 must be opened manually.

If however, it is decided to keep garage door 10 open; to clean out the garage, air out the garage, or any other reason, the cancel button Sw3 is pushed which energizes the circuit of Q4 and Q5 which interrupts the first solid state timer U2. A small light emitting diode LED1 will glow as an indication that the control device is in the canceled mode.

If the garage door is to be closed, the reset button Sw2 is pushed, LED1 will go off, and the circuit will reactivate the first solid state timer U2, and will close the door in approximately four or thirty minutes.

If the door is not closed, and remains open for some reason, photo resistor PC1, senses the ambient light level and when it starts to get dark (sensitivity is adjustable), the photo resistor circuit takes over and reactivates the first solid state timer U2 and the garage door will close in approximately four minutes or thirty minutes.

The add-on control device, which may serve as a safety device, is a simple add on device which can be connected in place of, or in parallel to, the manual service switch 15 of the garage door system, and can always be overridden by a manual or transmitted command.

The following are typical values of components that may be used in FIG. 5.

T1 Transformer with 120 vac primary and 9 vdc–200 ma secondary

Sw1*a* External Lever Operated Switch
Sw1*b* External lever Operated Switch
BP1 Solid State Beeper
PB1 Manual Push button Switch normally open
Sw2, Sw3 Momentary normally open Push button Switch
Sw4 Slide switch
LED1 Light emitting diode
C1,C3,C6 0.1 mfd disc capacitor
C2,C4,C6 100 mfd electrolytic capacitor
R1,R2,R8 2.2k ohm resistors
R3 1k ohm resistor
R4,R5,R6,R7,R9,R10,R17,R20,R22 10k ohm resistors
R11,R18,R19 4.7k ohm resistors
R12,R13,R16 100k ohm resistors
R14 10k ohm potentiometer
R15 1 meg ohm resistor
R21 150k ohm resistor
R23 10 meg ohm resistor
RE1 9 vdc 18 ma SPDT relay
U1 UA741 Op Amp
U2, U3, U4 555 I.C. Timer
PC1 Photoelectric Cell
Q1, Q2, Q3, Q4, Q5 2N2222 NPN Transistors
Q6, Q7, Q8, Q9 2N2907 PNP Transistors

What is claimed:

1. The combination of a garage door opener and an add-on control device for use with said garage door opener, comprising:

said garage door opener having a control arm which moves along a track to open and close a garage door;

a push button control for actuating said garage door opener;

a control circuit, connected in parallel with said push button control;

a switch mounted on said track, said switch being placed in a closed position when contacted by said control arm when the garage door starts to open to supply power to and actuate the control circuit;

a timing circuit having at least two selectable timing cycles for closing the garage door after a selected timing cycle;

a cancel circuit for canceling the selected timing cycle; and a reset circuit for re-initiating the selected timing cycle.

2. The combination according to claim 1, including a photo cell in the control circuit for closing the garage door when the light level impinging on the photo cell decrease to a preset level.

3. The combination according to claim 1, wherein said timing circuit timing cycle is variable over a predetermined timing range.

4. The combination according to claim 1, including a sound emitting device to emit a sound when the garage door is in motion.

5. The combination according to claim 1, wherein said cancel circuit is actuated by a push button switch to cancel the closing of the garage door after a selected timing cycle.

6. The combination according to claim 1, wherein said reset circuit is controlled by a push button switch to actuate a timing cycle to close the garage door.

7. The combination according to claim 1, including a second switch on said track to allow the garage door to be positioned in a partially opened position.

8. The combination of a garage door opener and an add-on control device for use with said garage door opener, comprising:

said garage door opener having a control arm which moves along a track to open and close a garage door;

a push button control for actuating said garage door opener;

a control circuit, connected in parallel with said push button control;

a switch mounted on said track, said switch being placed in a closed position when contacted by said control arm when the garage door is open to supply power to and actuate the control circuit;

a timing circuit having at least two selectable timing cycles for closing the garage door after a selected timing cycle;

a cancel circuit for canceling the selected timing cycle; and a reset circuit for re-initiating the selected timing cycle.

9. The combination according to claim 8, including a photo cell in the control circuit for closing the garage door when the light level impinging on the photo cell decrease to a preset level.

10. The combination according to claim 8, wherein said timing circuit timing cycle is variable over a predetermined timing range.

11. The combination according to claim 8, including a sound emitting device to emit a sound when the garage door is about to close and when it is in motion.

12. The combination according to claim 8, wherein said cancel circuit is actuated by a push button switch to cancel the closing of the garage door after the selected timing cycle.

13. The combination according to claim 8, wherein said reset circuit is controlled by a push button switch to actuate the selected timing cycle to close the garage door.

14. The combination according to claim 8, including a second switch on said track to allow the garage door to be positioned in a partially open position.

* * * * *